US008879741B2

(12) United States Patent
Fukuyama

(10) Patent No.: US 8,879,741 B2
(45) Date of Patent: Nov. 4, 2014

(54) SPEAKER ARRAY APPARATUS AND SOUND BEAM CONTROL METHOD

(75) Inventor: Tatsuya Fukuyama, Hamamatsu (JP)

(73) Assignee: Yamaha Corporation (JP)

( * ) Notice: Subject to any disclaimer, the term of this patent is extended or adjusted under 35 U.S.C. 154(b) by 417 days.

(21) Appl. No.: 12/721,763

(22) Filed: Mar. 11, 2010

(65) Prior Publication Data

US 2010/0310080 A1 Dec. 9, 2010

(30) Foreign Application Priority Data

Mar. 11, 2009 (JP) ..... 2009-057543

(51) Int. Cl.

| | |
|---|---|
| ***H04R 5/00*** | (2006.01) |
| ***H04R 1/40*** | (2006.01) |
| ***H04R 5/02*** | (2006.01) |
| ***H04R 3/12*** | (2006.01) |
| *H04S 7/00* | (2006.01) |

(52) U.S. Cl.

CPC . *H04R 3/12* (2013.01); *H04S 7/301* (2013.01); *H04S 2400/03* (2013.01); *H04R 2201/403* (2013.01); *H04R 2203/12* (2013.01)

USPC ..... 381/17; 381/307; 381/97

(58) Field of Classification Search

CPC .... H04R 3/12; H04R 1/403; H04R 2201/403; H04R 2400/03; H04R 2430/20; H04S 2400/03

USPC ..... 381/17, 18, 307, 303, 304, 306, 308, 381/80, 97, 95, 96

See application file for complete search history.

(56) References Cited

U.S. PATENT DOCUMENTS

| | | | |
|---|---|---|---|
| 7,577,260 | B1 | 8/2009 | Hooley |
| 7,889,878 | B2 | 2/2011 | Takumai |

(Continued)

FOREIGN PATENT DOCUMENTS

| | | | |
|---|---|---|---|
| EP | 1760920 | A | 7/2007 |
| JP | 2005-341208 | A | 12/2005 |
| JP | 2006-013711 | A | 1/2006 |
| JP | 2006067218 | A | 3/2006 |
| WO | 2008-155874 | A1 | 12/2008 |

OTHER PUBLICATIONS

European extended Search Report issued in corresponding European patent application No. EP1000258.4, dated Oct. 2, 2012.

(Continued)

*Primary Examiner* — Ping Lee

(74) *Attorney, Agent, or Firm* — Rossi, Kimms & McDowell LLP

(57) ABSTRACT

A speaker array apparatus includes a speaker array and a control section that controls audio signals corresponding to channels respectively so that the speaker array emits sound beams for the audio signal of a part of the channels in a plurality of directions and sound beams for the audio signals of the channels other than the part of the channels in a plurality of directions. One of the sound beams for the audio signal of the part of the channels is substantially identical in direction with one of the sound beams for the audio signals of the channels other than the part of the channels. Sound images for emitting sounds for the audio signals of the channels other than the part of the channels are formed and a phantom sound image for the audio signal of the part of the channels is formed at a position which is deviated from positions of the sound images.

6 Claims, 9 Drawing Sheets

(56) References Cited

U.S. PATENT DOCUMENTS

| | | | | |
|---|---|---|---|---|
| 8,199,925 | B2 | 6/2012 | Konagai | |
| 8,391,521 | B2 | 3/2013 | Takumai | |
| 2005/0089181 | A1* | 4/2005 | Polk, Jr. | 381/300 |
| 2005/0281408 | A1 | 12/2005 | Kim et al. | |
| 2006/0204022 | A1 | 9/2006 | Hooley | |
| 2007/0230724 | A1* | 10/2007 | Konagai et al. | 381/303 |
| 2008/0063211 | A1 | 3/2008 | Kusunoki | |
| 2008/0165979 | A1 | 7/2008 | Takumai | |
| 2010/0183157 | A1 | 7/2010 | Watanabe | |
| 2011/0013778 | A1 | 1/2011 | Takumai | |

OTHER PUBLICATIONS

Using Arrays of Loudspeakers for Focusing or Diffusing Sound, February meeting of Pacific Northwest Section of Audio Engineering Society (AES); http://www.aes.org/sections/pnw/ppt/ivantash/loudspeakerarraysforfocusinganddiffusingsound.pdf.

Japanese Office Action cited in Japanese counterpart application No. JP2013-119827, dated Apr. 30, 2014. English translation provided.

* cited by examiner

SPEAKER ARRAY APPARATUS AND SOUND BEAM CONTROL METHOD

BACKGROUND

The present invention relates to a surround reproduction technique using a speaker array.

A speaker array apparatus of the delay array system uses a technique in which, a plurality of speakers which are arranged linearly or planarly, outputs identical audio signals while applying delay times slightly different from one another to the audio signals so as to simultaneously reach the focal point in the space, so that the acoustic energy in the vicinity of the focal point is enhanced by in-phase addition with the result that a sound beam having a strong directivity in the focal direction is produced. In the speaker array apparatus, the delay process is performed for each of audio signals of multi channels (for example, C: center channel, FL: front L channel, FR: front R channel, SL: rear L channel, and SR: rear R channel). The delay-processed signals of the all channels are added together and then supplied to the speakers, whereby the sound beams for the multi channels can be simultaneously output with different directionalities (for example, Patent Reference 1).

When the technique disclosed in Patent Reference 1 is used, as shown in FIG. 10, a related speaker array apparatus 1000 can control the sound beams for the channels so as to reflect off the wall faces of a room 100 and then reach the listening position. Therefore, the listener 200 at the listening position perceives that the sound image is localized in the directions toward the wall faces, and sounds are emitted from the speaker array apparatus 1000 in the front side and also from virtual speakers 300-FL, 300-FR, 300-SL, 300-SR, and hence an excellent surround effect can be obtained.

In Patent Reference 1, furthermore, a technique is disclosed in which, in the case where the localized sound image is laterally asymmetric with respect to the listener 200 depending on the shape of the room 100, a phantom that is a virtual sound image is formed by a plurality of beams, and the sound image is symmetrically localized. In the case where the direction of localizing the sound image of the front R channel is to be changed, for example, the sound for the front R channel is mixed with the sound beam for the center channel, so that the direction of localizing the sound image of the front R channel is changed toward the direction of the sound image of the center channel.

[Patent Reference 1] JP-A-2006-13711

In such a speaker array apparatus which uses the reflection from wall faces, when the room has a usual shape (for example, a rectangular shape), and sound beams are reflected twice at the maximum off the wall faces and then reach the listener 200, the limitation is that the sound image is localized in five directions. Although it is not impossible to increase the directions in which the sound image is localized if sound beams are reflected three times off the wall faces, the control of the sound beams is very difficult.

SUMMARY

The invention has been conducted in view of the above-described circumstances. It is an object of the invention to provide a speaker array apparatus and a sound beam control method in which, in addition to localization of a sound image based on sound beams, also a sound image corresponding to another channel can be localized in a desired direction.

In order to solve the above-discussed problems, the invention provides a speaker array apparatus, comprising:

a speaker array; and a control section that controls a plurality of audio signals corresponding to a plurality of channels respectively so that the speaker array emits sound beams for the audio signal of a part of the channels in a plurality of directions and sound beams for the audio signals of the channels other than the part of the channels in a plurality of directions, wherein, when the sound beams in which the directionalities are controlled by the control section are emitted from the speaker array, sound images for emitting sounds for the audio signals of the channels other than the part of the channels are formed and a phantom sound image for the audio signal of the part of the channels is formed at a position which is deviated from positions of the sound images.

Preferably, the control section has a mixing section which mixes the audio signal of the part of the channels with the audio signals of the channels other than the part of the channels at a predetermined ratio. The position of the phantom sound image is deviated from the positions of the sound images based on the predetermined ratio. The control section controls the directionalities of the sound beams so that the one of the sound beams for the audio signal of the part of the channels is substantially identical in direction with one of the sound beams for the audio signals of the channels other than the part of the channels which is mixed with the one of the sound beams for the audio signal of the part of the channel by the mixing section.

Preferably, the control section controls directionalities of the sound beams so that one of the sound beams for the audio signal of the part of the channels is substantially identical in direction with one of the sound beams for the audio signals of the channels other than the part of the channels.

Preferably, the control section controls the directionalities of the sound beams so that the respective sound beams for the audio signal of the part of the channels are substantially identical in direction with the sound beams for the audio signals of the channels other than the part of the channels.

Preferably, the control section controls the directionalities of the sound beams so that the sound beams emitted from the speaker array which are substantially identical in direction to each other have different focal points.

According to the present invention, there is also provided a speaker array apparatus, comprising:

a speaker array;

a control section that controls a plurality of audio signals corresponding to a plurality of channels respectively so that the speaker array emits sound beams for the plurality of audio signals in directions corresponding to the plurality of channels; and a mixing section that mixes an audio signal of a channel other than the plurality of channels with the audio signals of two channel among the plurality of channels at a predetermined ratio, wherein, when the sound beams in which the directionalities are controlled by the control section are emitted from the speaker array, sound images for emitting sounds for the audio signals of the two channels are formed and a phantom sound image for the audio signal of the channel other than the plurality of channels is formed at a position which is deviated from positions of the sound images based on the predetermined ratio.

Preferably, the phantom sound image is formed by the sound beams for the audio signals of the two channels.

According to the present invention, there is also provided a sound beam control method, comprising:

controlling a plurality of audio signals corresponding to a plurality of channels respectively:

emitting sound beams for the audio signal of a part of the channels in a plurality of directions and sound beams for the audio signals of the channels other than the part of the channels in a plurality of directions under the control process;

forming sound images for emitting sounds for the audio signals of the channels other than the part of the channels and a phantom sound image for the audio signal of the part of the channels at a position which is deviated from positions of the sound images, when the sound beams are emitted from a speaker array under the control process, wherein, in the control process, directionalities of the sound beams are controlled so that one of the sound beams for the audio signal of the part of the channels is substantially identical in direction with one of the sound beams for the audio signals of the channels other than the part of the channels.

Preferably, in the control process, the audio signal of the part of the channels is mixed with the audio signals of the channels other than the part of the channels at a predetermined ratio. The position of the phantom sound image is deviated from the positions of the sound images based on the predetermined ratio. The one of the sound beams for the audio signal of the part of the channels is substantially identical in direction with one of the sound beams for the audio signals of the channels other than the part of the channels which is mixed with the one of the sound beams for the audio signal of the part of the channel by the mixing section under the control process.

Preferably, the respective sound beams for the audio signal of the part of the channels are substantially identical in direction with the sound beams for the audio signals of the channels other than the part of the channels.

Preferably, the sound beams emitted from the speaker array which are substantially identical in direction to each other have different focal points.

According to the present invention, there is also provided a sound beam control method, comprising:

controlling a plurality of audio signals corresponding to a plurality of channels respectively;

mixing an audio signal of a channel other than the plurality of channels with the audio signals of two channel among the plurality of channels at a predetermined ratio;

emitting sound beams for the plurality of audio signals in directions corresponding to the plurality of channels from a speaker array under the control process; and forming sound images for emitting sounds for the audio signals of the two channels and a phantom sound image for the audio signal of the channel other than the plurality of channels at a position which is deviated from positions of the sound images based on the predetermined ratio.

Preferably, the phantom sound image is formed by the sound beams for the audio signals of the two channels.

According to the invention, it is possible to provide the speaker array apparatus and the sound beam control method in which, in addition to localization of a sound image based on the sound beams, also the sound image corresponding to another channel can be localized in a desired direction.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Hereinafter, an embodiment of the invention will be described.

<Embodiment>

A speaker array apparatus 1 according to the embodiment of the invention receives an audio signal Sin configured by a plurality of channels, in the example, 7.1 channels (C: center, FL: front L, FR: front R, SL: surround L, SR: surround R, SBL: surround back L, SBR: surround back R, and LFE: sub-woofer), and can form sounds for the channels into beams, and output the beams in directions corresponding to the channels. Hereinafter, the configuration of the speaker array apparatus 1 will be described. The LFE receives an audio signal for a sub-woofer in the low-frequency band. Such an audio signal has little directivity, and is not subjected to an acoustic process which will be described later. Therefore, the description of the LFE is omitted.

Figure 1:
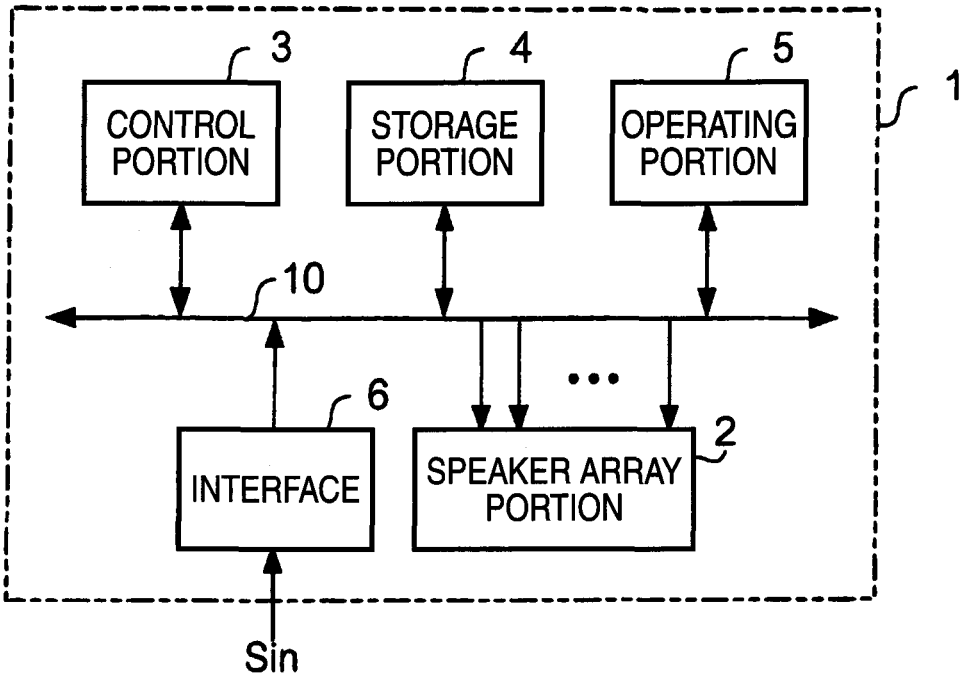
FIG. 1 is a block diagram showing the configuration of a speaker array apparatus of an embodiment of the invention.
Figure 2:
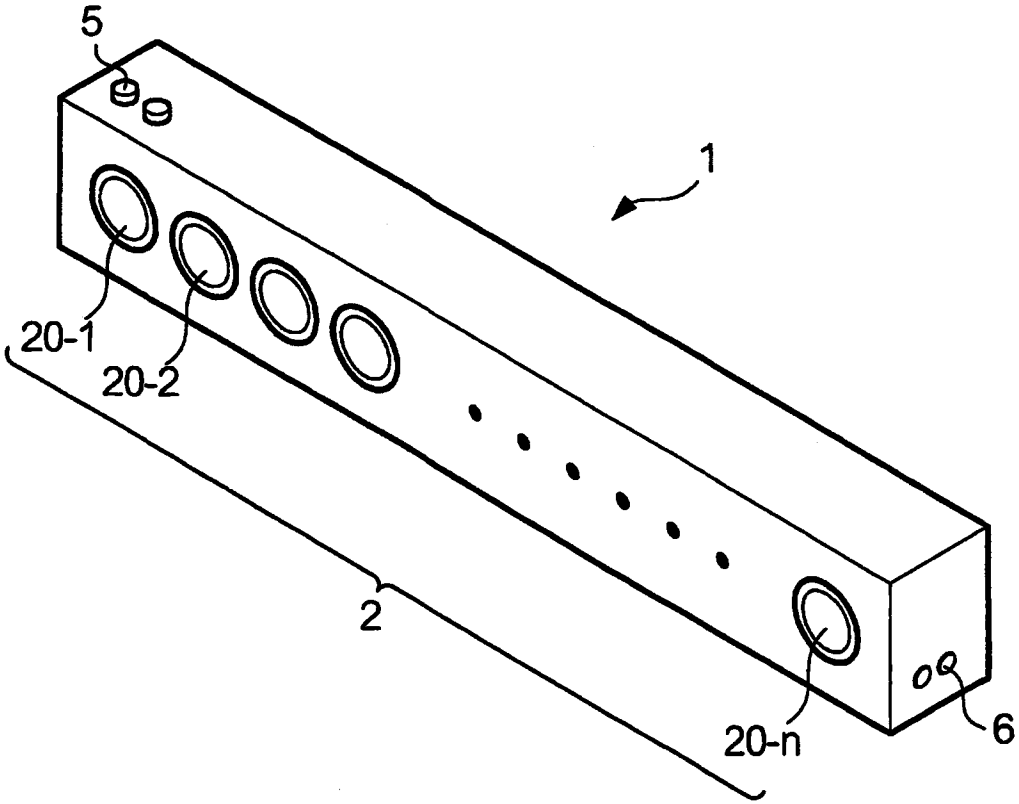
FIG. 2 is a view showing the appearance of the speaker array apparatus of the embodiment of the invention.

FIG. 1 is a block diagram showing the configuration of the speaker array apparatus 1, and FIG. 2 is an external view of the speaker array apparatus 1. A control portion 3 has a CPU (Central Processing Unit), a DSP (Digital Signal Processor), a RAM (Random Access Memory), and the like, and executes control programs and the like stored in a storage portion 4, whereby various portions of the speaker array apparatus 1 are controlled through a bus 10 to realize functions such as application of the acoustic process on audio signals of the channels constituting the audio signal Sin which will be described later. The function of applying the acoustic process is not limited to the software realization by execution of the control programs, and may be realized by hardware.

The storage portion 4 is a storage unit such as a ROM (Read Only Memory) or a hard disk drive, and stores the above-described control programs, various set parameters, etc.

An operating portion 5 is a operating unit for inputting instructions for adjusting a volume for adjusting a sound volume level, and changing settings, and outputs a signal indicative of the operation contents to the control portion 3. An interface 6 is configured by input terminals for obtaining an audio signal from the outside, and the like, and, in the example, receives the audio signal Sin configured by a plurality of channels.

A speaker array portion 2 is disposed on the front face of the speaker array apparatus 1, and, as shown in FIG. 2, has a plurality of speakers 20-1, 20-2, . . . , 20-n (hereinafter, when the speakers are not distinguished from one another, referred to as the speakers 20) which are arranged in one direction, and which are substantially omnidirectional, and emits audio signals which have been subjected to the acoustic process as described later, from the speakers 20, whereby formation of sounds into beams is realized.

In FIG. 2, the speakers 20 are linearly arranged in one row. However, the speakers may be arranged in any manner as far as the speakers constitute a speaker array. For example, a plurality of columns each configured by speakers which are arranged in a line may be juxtaposed in parallel. Alternatively, speakers having different diameters may be disposed, and used in accordance with the frequency bands of the audio signals.

Figure 3:
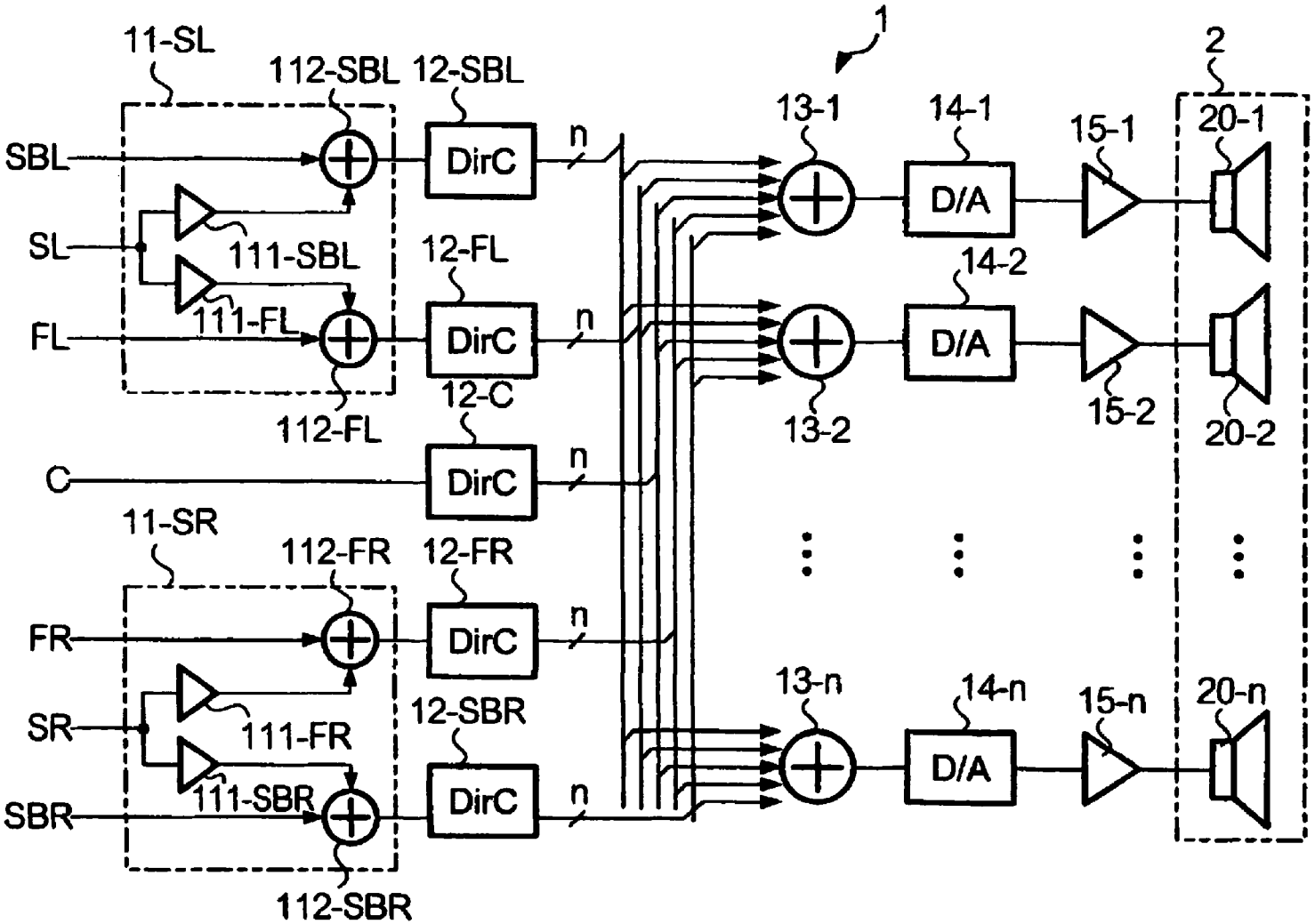
FIG. 3 is a block diagram showing a process of processing an audio signal in the speaker array apparatus of the embodiment of the invention.

Next, the acoustic process which is performed on the audio signal of each channel will be described with reference to FIG. 3. FIG. 3 is a view illustrating the flow of the process from inputting of the audio signals of the channels to emission from the speakers 20.

A mixing portion 11-SL has level adjusters 111-SBL, 111-FL and adders 112-SBL, 112-FL. The mixing portion 11-SL adjusts the levels of the audio signals of the channel SL with predetermined adjusting amounts, then mixes the resulting signals with the audio signals of the channels SBL, FL.

The level adjusters 111-SBL, 111-FL adjust the levels of the audio signals of the channel SL to, in the example, set the level to ½. The adders 112-SBL, 112-FL add the audio signals of the channel SL whose levels are adjusted by the level adjusters 111-SBL, 111-FL, to the audio signals of the channels SBL, FL, respectively, and outputs the addition results. The ratio (in the example, 1:1) of the level adjusting amounts of the level adjusters 111-SBL, 111-FL determines the position where a phantom sound image (a phantom speaker 301-SL, see FIG. 4) is formed as described later.

In the example, the level adjustment in which the levels are set to ½ respectively is performed so that a total of 1 is attained. However, the level adjustment is not limited to this example. For example, the level adjustment in which the level is set to ⅔ may be performed. Depending on the position where a phantom sound image is formed, the ratio of the adjusting amounts may be set to a value other than 1:1. For example, the ratio may be set so that the level adjusting amounts of the level adjusters 111-SBL, 111-FL are ⅔ and ⅓ or ¾ and ⅔, respectively. The level adjusting amounts of the level adjusters 111-SBL, 111-FL may be preset by an operation performed on the operating portion 5, setting parameters stored in the storage portion 4, or the like, in accordance with the setting environment of the speaker array apparatus 1, the taste of the listener, or the like.

A mixing portion 11-SR adjusts the levels of the audio signals of the channel SR with respective predetermined adjusting amounts, then mixes the resulting signals with the audio signals of the channels SBR, FR, and is different from the mixing portion 11-SL only in the handling channels. Therefore, the description of the mixing portion will be omitted.

A directivity control portion (DirC) 12-SBL has delaying portions corresponding to the speakers 20, and supplies the audio signal of the channel SBL to which the audio signal of the channel SL is added in the adder 112-SBL, to an n number of signal lines corresponding to the speakers 20. The delaying portions delay the audio signals to be supplied to the signal lines corresponding to the speakers 20, respectively. The delay amounts are determined respectively so that the beam of the sound for the audio signal is output with being directed in the set direction. In this way, the directivity of the beam of the sound for the channel SBL is controlled.

In each of directivity control portions 12-FL, 12-C, 12-FR, 12-SBR, in a similar manner as the directivity control portion 12-SBL, the audio signals of the channels are supplied to the n number of signal lines corresponding to the speakers 20, and the audio signals to be supplied to the signal lines are delayed so that the sound beams for the channels are output with being directed in the set direction. The levels of the audio signals to be supplied to the signal lines may be adjusted.

The audio signals of the channels FR, SBR which are supplied to the directivity control portions 12-FR, 12-SBR are signals to which the audio signal of the channel SR is added in adders 112-FR, 112-SBR, respectively. Similarly, the audio signals of the channels FL, SBL which are supplied to the directivity control portions 12-FL, 12-SBL are signals to which the audio signal of the channel SL is added in the adders 112-FL, 112-SBL, respectively. On the other hand, the audio signal which is supplied to the directivity control portion 12-C is the audio signal of the channel C.

The directivity control portions 12-SBL, 12-FL, 12-C, 12-FR, 12-SBR perform also a delay process in which, in accordance with the length of the path of the beam of the sound for the audio signal of each channel emitted from the speaker array apparatus 1, to the listener 200 (see FIG. 4), the difference from the path lengths of the other channels is adjusted. The delay time related to the delay process is set so that the audio signals of the channels which are input into the speaker array apparatus 1 at the same timing reach the listener 200 at a substantially same timing. This is not related to the control of the directivity. In each of the directivity control portions, therefore, the same delay time is set for the whole of the n number of signal lines.

An adding portion 13-1 adds together the audio signals which are supplied from the directivity control portions 12-SBL, 12-FL, 12-C, 12-FR, 12-SBR to the signal lines corresponding to the speaker 20-1. Similarly, adding portions 13-2, 13-3, . . . , 13-n add together the audio signals which are supplied to the signal lines corresponding to the speakers 20-2, 20-3, . . . , 20-n, respectively.

D/A converters 14-1, 14-2, . . . , 14-n D/A-convert the audio signals which are obtained in the additions of the adding portions 13-1, 13-2, . . . , 13-n.

Amplifying portions 15-1, 15-2 . . . , 15-n amplify the audio signals which are D/A-converted in the D/A converters 14-1, 14-2, . . . , 14-n, and then supply the signals to the speakers 20-1, 20-2, . . . , 20-n to emit the signals therefrom. The beams of the sounds for the channels which are emitted from the speaker array portion 2 respectively are output in the respective set directions. The speaker array apparatus 1 is configured as described above.

Next, the operation of the speaker array apparatus 1 and localization of a sound image will be described. The speaker array apparatus 1 is placed at the position shown in FIG. 4 (in the vicinity of a wall face in an upper portion of the figure) when viewing the room 100 from the upper side.

Figure 4:
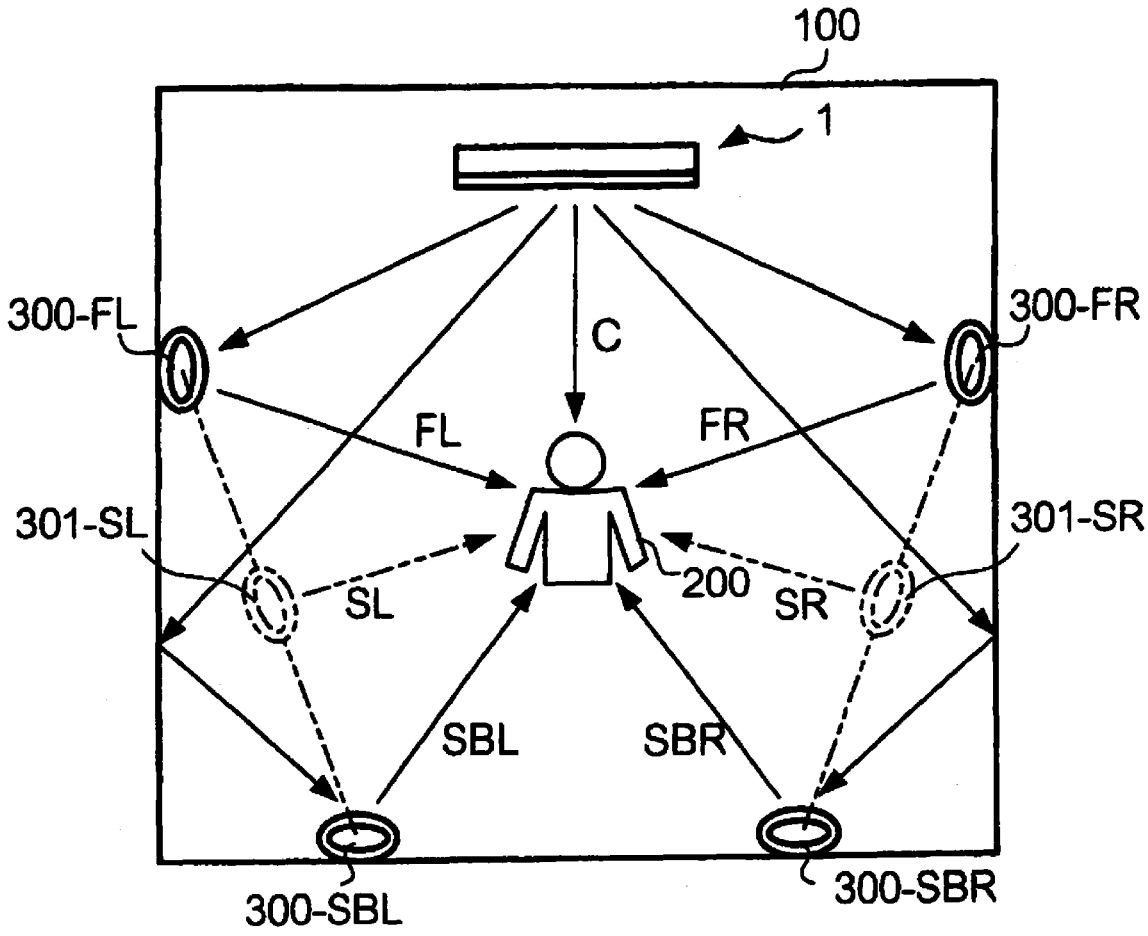
FIG. 4 is a view illustrating paths of sound beams output from the speaker array apparatus of the embodiment of the invention, and localization of a sound image.

FIG. 4 is a view illustrating paths of sound beams output from the speaker array apparatus, and localization of sound images. First, the control portion 3 sets directionalities which are controlled in the directivity control portions 12-SBL, 12-FL, 12-C, 12-FR, 12-SBR. This setting is performed in the following manner. The speaker array apparatus 1 outputs a sound beam of various sound while scanning the sound beam in various directions. The sound beam is picked up by a microphone which is disposed at the listening position of the listener 200. The directionalities are set in accordance with the sound beam direction in the case where the pick-up level is high.

Alternatively, the listening position and the shape of the room 100 may be set by operating the operating portion 5, or set parameters indicative of the listening position and the shape of the room 100 may be read out from the storage portion 4. In accordance with these settings, the directionalities for allowing sound beams for the channels to reach the listening position may be set.

In a state where the directionalities are set in this way, the speaker array apparatus 1 emits sounds from the speaker array portion 2. As shown by the solid lines (C, FR, FL, SBR, SBL) in FIG. 4, then, beams of the sounds are output in five directions, and reach the listening position (sound receiving position) directly (C) or while reflecting off wall faces (FR, FL, SBR, SBL).

For the listener 200, therefore, the sound image is localized in the direction of the speaker array apparatus 1 (C) and the directions of the wall faces (FR, FL, SBR, SBL). As a result, speakers (sound images) are virtually formed also in the directions of the wall faces. The speakers (sound images) are referred to as virtual speakers 300-FR, 300-FL, 300-SBR, 300-SBL. Whether the virtual speakers 300-FR, 300-FL, 300-SBR, 300-SBL are located on the wall faces as shown in FIG. 4 or not depends on the setting of the focal lengths of the output sound beams. In the example, it is assumed that the virtual speakers are located on the wall faces.

At this time, the listener 200 listens the sounds for the audio signals of the channels FL, SBL from the virtual speakers 300-FL, 300-SBL. Furthermore, the listener 200 listens also the sound for the audio signal of the channel SL from the virtual speakers 300-FL, 300-SBL. The listener 200 listens the sound for the audio signal of the channel SL in a sound volume balance of approximately 1:1 from the respective virtual speakers 300-FL, 300-SBL, and hence feels as if the sound image is localized in a substantially middle portion between the virtual speakers 300-FL, 300-SBL, with the result that a phantom sound image (the phantom speaker 301-SL) is formed.

The position where the phantom sound image is formed is changed in accordance with the ratio of the level adjusting amounts in the level adjusters 111-SBL, 111-FL. When the level of the level adjuster 111-SBL is set to be higher than that of the level adjuster 111-FL, for example, the position of the phantom sound image becomes closer to the virtual speaker 300-SBL.

Similarly, the listener 200 listens the sounds for the audio signals of the channels FR, SBR from the virtual speakers 300-FR, 300-SBR, and also the sound for the audio signal of the channel SR from the both virtual speakers 300-FR, 300-SBR. Therefore, the listener feels as if the sound image is localized in a substantially middle portion between the virtual speakers 300-FR, 300-SBR, with the result that a phantom sound image (a phantom speaker 301-SR) is formed.

As described above, in the speaker array apparatus 1 according to the embodiment, the audio signals of a part of the channels (C, FL, FR, SBL, SBR) are output in the respective directions, as sound beams having a directivity, and then reach the listener 200, thereby forming the virtual speakers for outputting the sounds for the audio signals of the part of the channels (C, FL, FR, SBL, SBR). At this time, the audio signals of the channels (SL, SR) are mixed with the audio signals of the channels (FL, FR, SBL, SBR) so that the sounds for the audio signals of the remaining channels (SL, SR) are output in two directions among the directions, whereby the phantom sound images (SL,SR) i.e., phantom speakers, are localized in directions different from the directions in which the sound beams reach the listener 200. The phantom speakers outputting the sounds for the audio signals of the remaining channels (SL, SR) are formed.

When the sound beams reach the listener 200, sound images for the audio signals of the channels allocated to the all respective sound beams can be localized in the respective directions. Even when a use of a path along which a sound beam cannot reach the listener 200 is required to form a desired sound image for a specific channel in a desired direction, a phantom sound image is formed by using a plurality of sound beams which can reach the listener 200, so that the desired sound image can be localized. Even in the case where channels are allocated to all the number (a substantially maximum number is five) of formable virtual speakers which depends on the shape of the room, therefore, the speaker array apparatus can cope with a surround configured by channels the number of which is larger than the number of the virtual speakers.

Although the embodiment of the invention has been described above, the invention may be implemented in various modifications as described below.

<Modification 1>

In the embodiment described above, the speaker array apparatus 1 outputs sound beams in five directions. Alternatively, sound beams may be output in directions the number of which is larger than five (in the example, nine directions). In the alternative, a speaker array apparatus 1A may have the configuration shown in FIG. 5.

Figure 5:
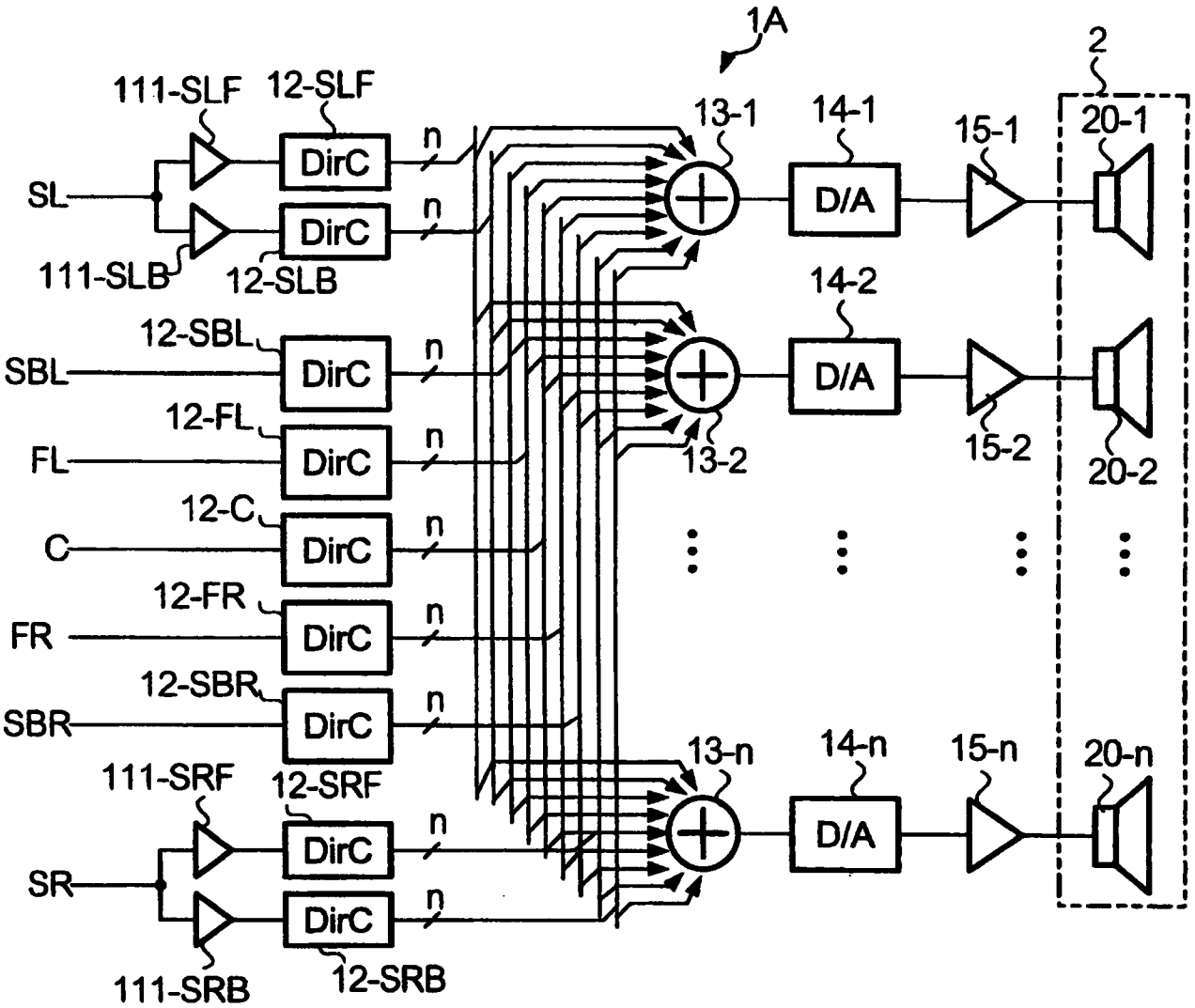
FIG. 5 is a block diagram showing a process of processing an audio signal in a speaker array apparatus of Modification 1.

FIG. 5 is a block diagram showing the configuration of the speaker array apparatus 1A of Modification 1. Unlike the configuration of the embodiment, signal paths of the channels SL, SR have directivity control portions 12-SLF, 12-SLB and 12-SRF, 12-SRB so that the directionalities of sounds for the audio signals of the channels are independently controlled, respectively.

Even when the directionalities of sounds can be independently controlled, the directionalities are required to be substantially identical with those of the case of five directions in the embodiment, in order to allow the sounds to reach the listener 200 as sound beams. Therefore, the directionalities of the directivity control portions 12-SLF, 12-SLB, 12-SRF, 12-SRB are set to be substantially identical with those related to the directivity control portions 12-FL, 12-SBL, 12-FR, 12-SBR. The term "substantially identical" is not limited to the case of complete coincidence, but includes, for example, the cases where directed directions are deviated by several degrees, and where the focal lengths are different. Also such a deviation shows the range where sound beams are caused to reach the listener 200 by spread of sound beams or the like.

Similarly with the level adjusters 111-SBL, 111-FL in the embodiment, level adjusters 111-SLF, 111-SLB determine the position where a phantom sound image is formed, by the ratio of the adjusting amounts of the audio signals of the channel SL. Also level adjusters 111-SRF, 111-SRB determine the position where a phantom sound image is formed, in a similar manner.

According to this configuration, the directionalities of beams of sounds for forming a phantom sound image can be controlled separately from those of beams of sounds for forming the virtual speakers (the sound images). Namely, the virtual speakers for forming the phantom sound image can be controlled in position independently from the other virtual speakers.

Figure 6A:
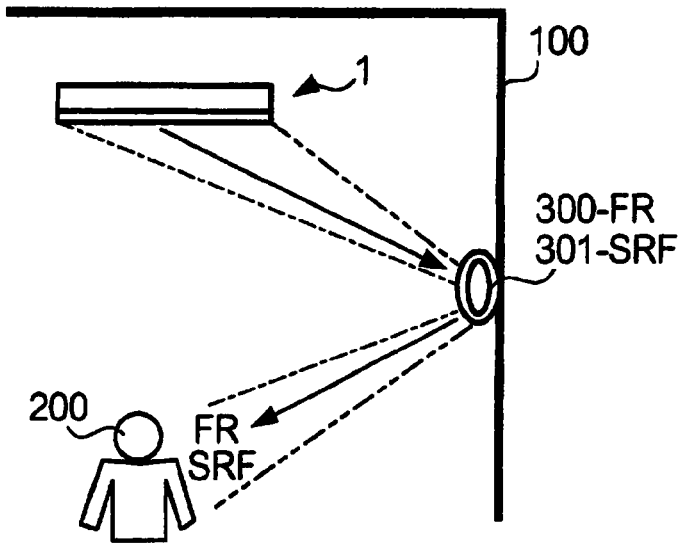
FIGS. 6A to 6C are views illustrating virtual speakers in Modification 1.
Figure 6B:
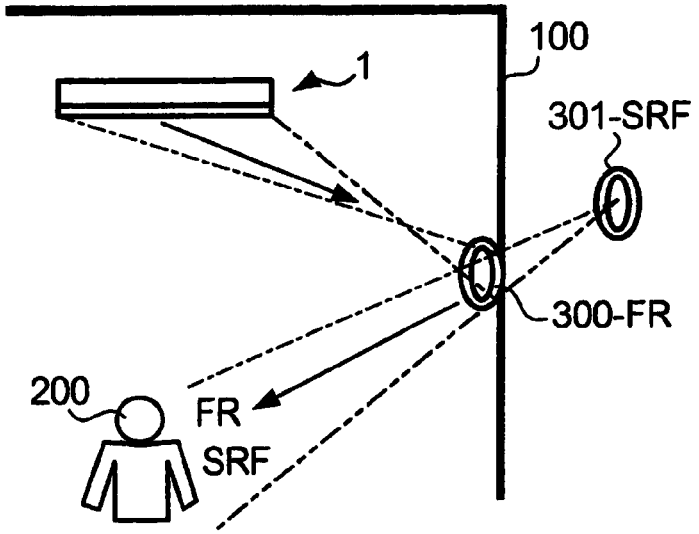
Figure 6C:
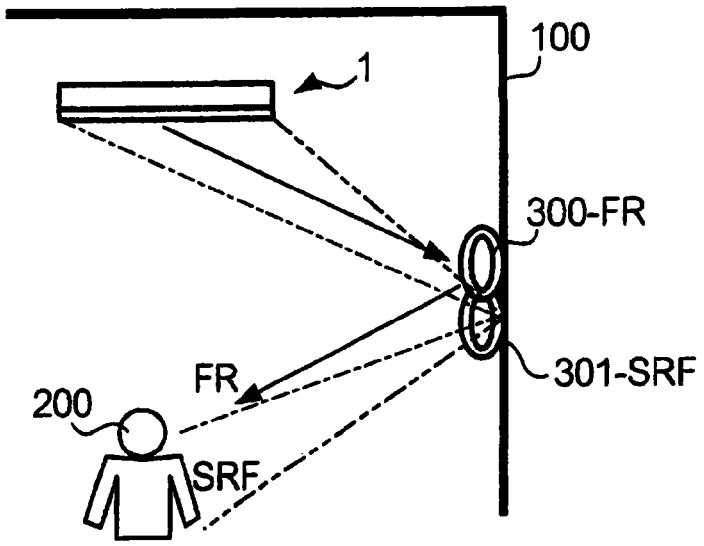

FIGS. 6A to 6C are views illustrating virtual speakers 300-SRF, 300-FR. The virtual speaker 300-SRF is formed by the beam of the sound whose directivity is controlled by the directivity control portion 12-SRF, and is one of the virtual speakers for forming a phantom sound image. In FIGS. 6A to 6C, the width of the beams is indicated by the dashed-dotted line and the dashed-two dotted line. Similarly with the embodiment, the virtual speaker 300-FR is fixed as a speaker for forming the virtual speaker (sound image) 300-FR.

FIG. 6A shows a case where the directivity control portions 12-SRF, 12-FR control respective directionalities of beams for the virtual speakers 300-SRF, 300-FR so as to be identical with each other. In this case, the virtual speakers 300-SRF, 300-FR are identical with each other, and the state of the modification is substantially identical with that of the embodiment. On the other hand, FIG. 6B shows a case where the directions of the sound beams for the virtual speakers 300-SRF, 300-FR are identical with each other, but the focal lengths of the sound beams for the virtual speakers 300-SRF, 300-FR are different from each other. In this case, the arrival directions of the sound images (the virtual speakers 300-SRF, 300-FR) in view from the listener 200 are identical with each other, but the distances from the listener 200 to the virtual speakers 300-SRF, 300-FR are different from each other. FIG. 6C shows a case where the directions of the sound beams for the virtual speakers 300-SRF, 300-FR are different from each other. In this case, the arrival directions of the sound images (the virtual speakers 300-SRF, 300-FR,) in view from the listener 200 are different from each other.

In this way, the directionalities of the beams of the sound for forming a phantom sound image are controlled separately from those of beams of sounds for forming virtual speakers, as shown in FIG. 6B or 6C, whereby the localization of a sound image related to the formation of a phantom sound image can be more clarified.

In FIG. 6C, the directions of the sound beams deviated in the horizontal direction to each other. In a configuration where the directions of the sound beams can be controlled in the vertical direction, such as a configuration where, a plurality of columns in the speaker array portion 2, each of the columns has speakers arranged in a line, are arranged in parallel, the directions of the sound beams may be deviated in the vertical direction. In this case, it is preferable that, when one of two sound beams for forming a phantom sound image is upward deviated in the room, the other sound beam is downwardly deviated.

<Modification 2>

A speaker array apparatus 1B may be configured where, in the speaker array apparatus 1A of Modification 1 described above, the directivity of one of two sound beams for forming a phantom sound image is made identical with the directivity of a sound beam for the virtual speaker corresponding to another channel to form the mode in the embodiment (in the example, seven directions). In this case, the speaker array apparatus 1A may have the configuration shown in FIG. 7.

Figure 7:
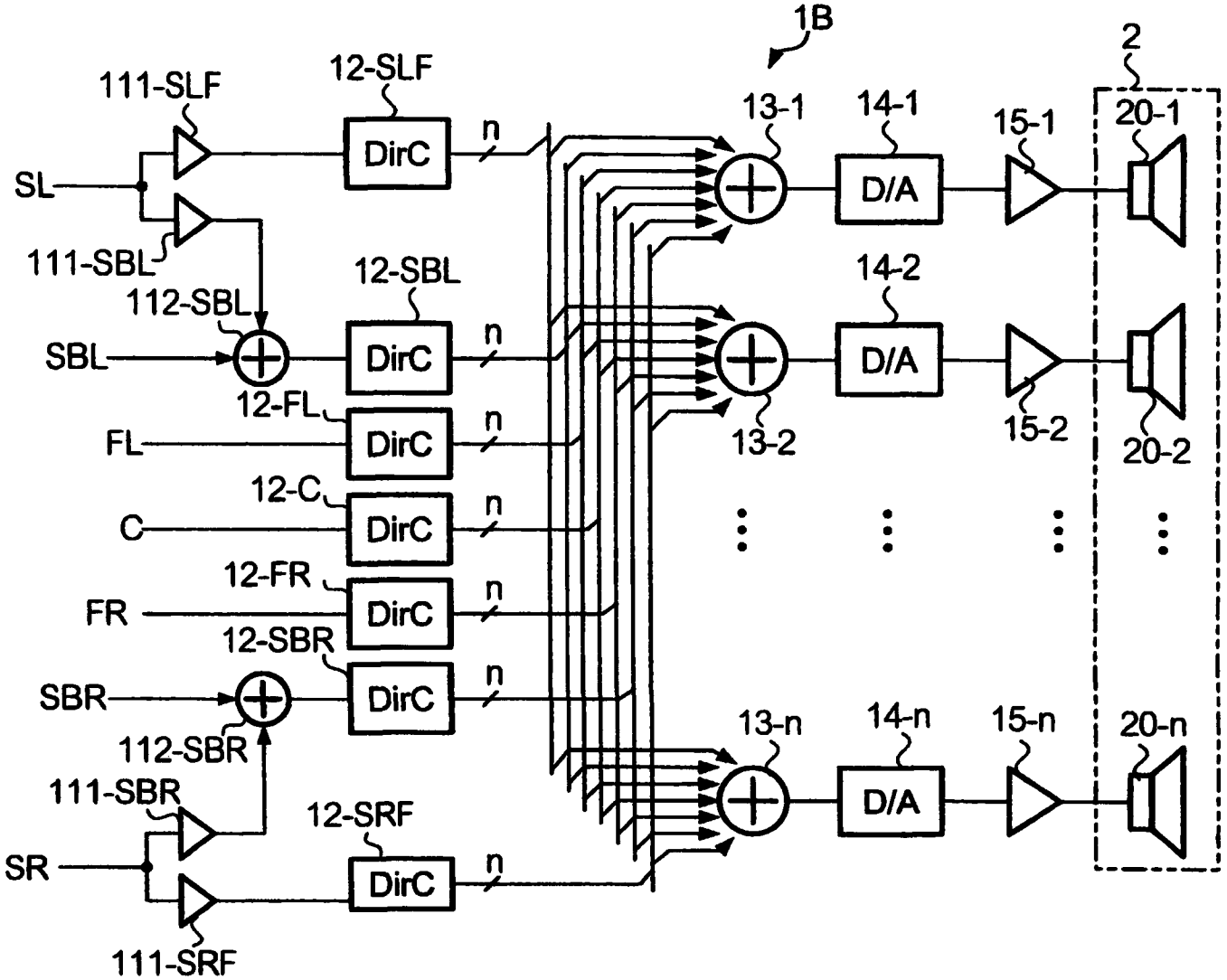
FIG. 7 is a block diagram showing a process of processing an audio signal in a speaker array apparatus of Modification 2.

FIG. 7 is a block diagram showing an example of the configuration of the speaker array apparatus 1B of Modification 2. As shown in FIG. 7, with respect to the audio signals of the channel SL, as in the configuration of Modification 1, the directivity of one sound beam for one of the audio signals of the channel SL is independently controlled by the directivity control portion 12-SLF so as to be substantially identical with the directivity which is controlled by the directivity control portion 12-FL, and, the other sound beam for the other of the audio signals of the channel SL is mixed with the audio signal of the channel SBL by the level adjuster 111-SBL and the adder 112-SBL, so that the directivity of the other sound beam for the other of the audio signals of the channel SL is identical with the directivity which is controlled by the directivity control portion 12-SBL. The audio signal of the channel SR is processed in a similar manner. In the case where the audio signal of the channel SL is mixed with the audio signal of the channel FL, the directivity of the sound beam in which the directivity is independently controlled may be substantially identical with the directivity which is controlled by the directivity control portion 12-SBL.

<Modification 3>

In the embodiment described above, the formation of the phantom sound image for the channel SL is realized by the formation of the virtual speakers 300-FL, 300-SBL for the adjacent channels FL, SBL in the speaker array apparatus 1. Alternatively, a plurality of phantom sound images may be formed between adjacent virtual speakers in a speaker array apparatus 10 as shown in FIG. 9. In the alternative, the speaker array apparatus 10 may have the configuration as shown in FIG. 8.

Figure 8:
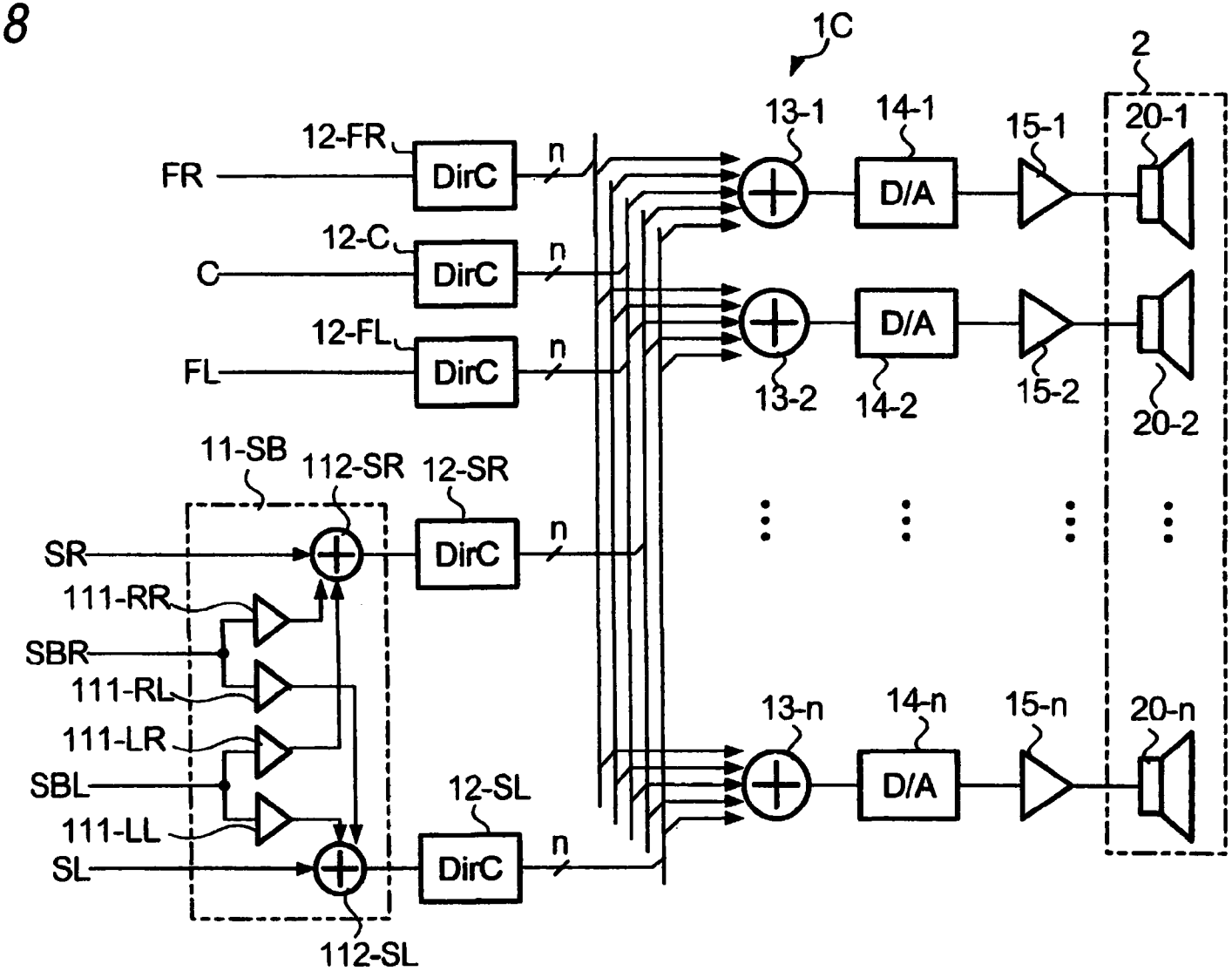
FIG. 8 is a block diagram showing a process of processing an audio signal in a speaker array apparatus of Modification 3.
Figure 9:
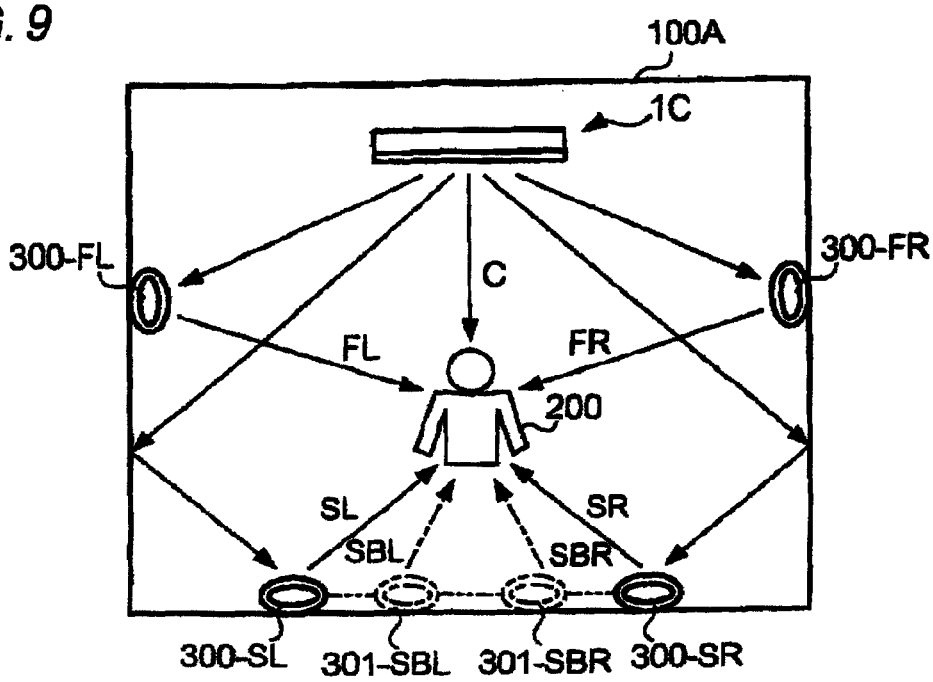
FIG. 9 is a view illustrating paths of sound beams output from the speaker array apparatus of Modification 3, and localization of a sound image.
Figure 10:
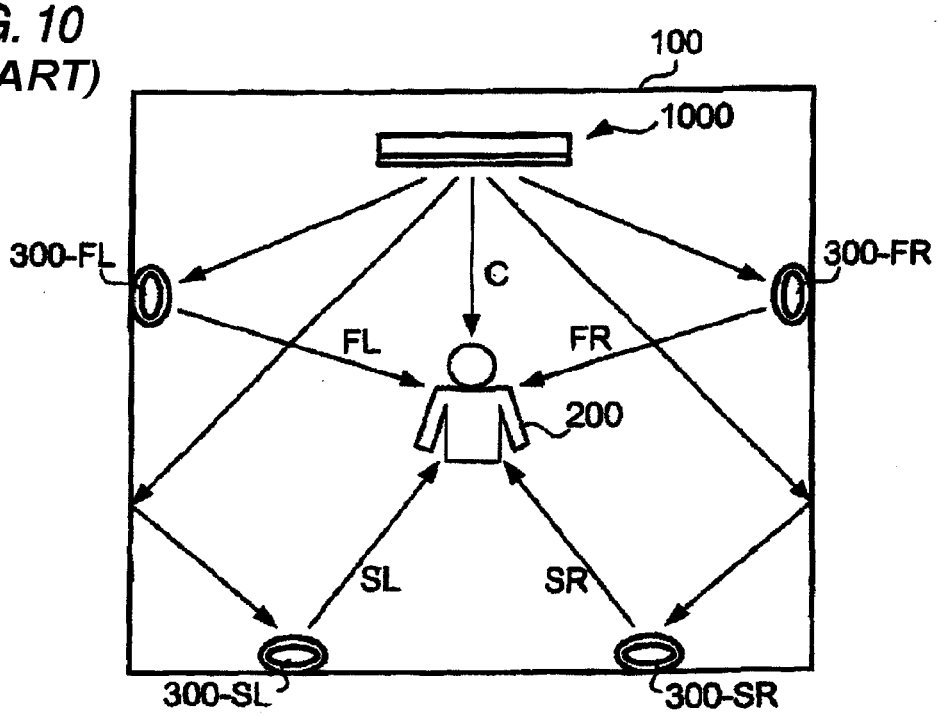
FIG. 10 (PRIOR ART)
FIG. 10 is a view illustrating paths of sound beams output from the related speaker array apparatus.

FIG. 8 is a block diagram showing an example of the configuration of the speaker array apparatus 10 of Modification 3. As shown in FIG. 8, a mixing portion 11-SB having level adjusters 111-RR, 111-RL, 111-LR, 111-LL and adders 112-SR, 112-SL may be provided. Similarly with the embodiment, the audio signals of the channel SBR are mixed with the audio signals of the channels SR, SL, and also the audio signals of the channel SBL are mixed with the audio signals of the channels SR, SL. In the mixing portion 11-SB, namely, the channels of the audio signals to which the mixing is applied in the mixing portions 11-SL, 11-SR are commonized.

The paths of the sound beams in the configurations of FIGS. 3A and 8 are different from each other as described later. Therefore, the channels forming the virtual speakers are indicated as the channels SL, SR and not as the channels SBL, SBR, and hence directivity control portions 12-SL, 12-SR are used. Since the input channels in this modification are different from the input channels in the embodiment, the reference numerals of the directivity control portions are changed, but the directivity control portions are identical in function with the other ones.

FIG. 9 is a view illustrating paths of sound beams output from the speaker array apparatus 1C, and localization of sound images. A room 10A shown in FIG. 9 is different in shape from the room 100 in the embodiment, and also the paths of sound beams are different. The virtual speakers 300-FL, 300-FR, 300-SL, 300-SR are formed, and the sound images for the channels FL, FR, SL, SR are localized with respect to the listener 200. Furthermore, phantom sound images (phantom speakers 301-SBL, 301-SBR) are formed by the virtual speakers 300-SL, 300-SR, and the sound images for the channels SBL, SBR are localized.

In the case where a plurality of phantom sound images are formed between two virtual speakers, the ratio of the adjusting amounts of the level adjusters 111-RR, 111-RL is made different from the ratio of the adjusting amounts of the level adjusters 111-LR, 111-LL. For example, the former is set to 2:1 and the latter is set to 1:2, and the phantom sound images are formed approximately at positions such as shown in FIG. 9. Although two phantom sound images are formed between the two virtual speakers in the modification, a larger number of phantom sound images, for example, three or more of phantom sound images may be formed.

<Modification 4>

In the embodiment described above, it is assumed to use 7.1-ch audio signals. Alternatively, a larger number of channels may be used. A phantom sound image may be formed between any two of the virtual speakers, or by using three or more virtual speakers. As shown in Modification 3, a plurality of phantom sound images may be formed between two virtual speakers. Namely, these formation manners may be combined with each other to form phantom sound images at various positions, whereby five channels which are a part of the whole channels are allocated to virtual speakers, and the channels other than the part are allocated to the formed phantom sound images.

<Modification 5>

The configuration of the speaker array apparatus 1 of the embodiment described above, and the configurations of the speaker array apparatuses 1A, 1B, 1C may be switched over. The switching may be instructed by operating the operating portion 5.

In the relationship between the speaker array apparatuses 1 and 1C, the configurations of the speaker array apparatuses 1 and 1C may be automatically switched over in accordance with the arrival direction of the sound beam in view from the listener 200 (the direction of a virtual speaker). For example, the arrival direction of the sound beam is determined by determination of the direction of the sound beam. For example, a table in which the kinds of channels are correlated to arrival directions (angular ranges) of virtual speakers in view from the listener 200 may be stored in the storage portion 4. While referring to the table, the virtual speakers may be made correspondent with the channels.

In accordance with the arrival directions of the sound beams in view from the listener 200, channels in which the listener 200 listens through virtual speakers and channels in which the listener listens through phantom sound images may be determined. The channels in which the listener listens through the virtual speakers may be allocated to the respective directions.

<Modification 6>

In the embodiment described above, sounds for the channels are formed into beams by the delaying portions of the directivity control portions 12-SBL, 12-FL, 12-C, 12-FR, 12-SBR. Alternatively, this process may be realized by an FIR (Finite Impulse Response) filtering process.

<Modification 7>

The control programs in the embodiment described above may be provided in a state where the programs are stored in a computer readable storage medium such as a magnetic storage medium (a magnetic tape, a magnetic disk, or the like), an optical storage medium (an optical disk or the like), a magnetooptical storage medium, or a semiconductor memory. Alternatively, a communicating portion which can be connected with a network may be disposed, and the control programs may be downloaded via the network such as the Internet.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2009-057543 filed on Mar. 11, 2009, the contents of which are incorporated herein for reference.

What is claimed is:

1. A speaker array apparatus comprising:

a speaker array comprising a plurality of speakers;

a signal divider that divides an input audio signal of a first channel into first and second audio signals at a predetermined ratio;

a first mixer that mixes the first audio signal with an input audio signal of a second channel that is different from the first channel and outputs a first mixed audio signal;

a second mixer that mixes the second audio signal with an input audio signal of a third channel that is different from the first and second channels and outputs a second mixed signal; and a control portion that controls directivities of the first and second mixed audio signals by controlling delay times of the first and second mixed audio signals input to each of the speakers so that the speaker array emits first and second sound beams of the first and second mixed audio signals, respectively, in directions corresponding respectively to the second and third channels, which are directed to a wall surface that reflects the first and second mixed audio signals, without separately emitting a sound beam of the first channel so that a total number of emitted beams is less than a number of the input audio signals of the first, second, and third channels.

2. The speaker array apparatus according to claim 1, wherein a phantom sound image is formed by the first and second sound beams.

3. A sound beam control method for a speaker array apparatus having a speaker array comprising a plurality of speakers, a signal divider, a first mixer, a second mixer, and a control portion that controls directivity of sound beams, the method comprising:

a signal dividing step of dividing, with the signal divider, an input audio signal of a first channel into first and second audio signals at a predetermined ratio;

a first mixing step of mixing, with the first mixer, the first audio signal with an input audio signal of a second channel that is different from the first channel and outputting a first mixed audio signal;

a second mixing step of mixing, with the second mixer, the second audio signal with an input audio signal of a third channel that is different from the first and second channels and outputting a second mixed signal; and a control step of controlling, with the control portion, directivities of the first and second mixed audio signals by controlling delay times of the first and second mixed audio signals input to each of the speakers so that the speaker array emits first and second sound beams of the first and second mixed audio signals, respectively, in directions corresponding respectively to the second and third channels, which are directed to a wall surface that reflects the first and second mixed audio signals, without separately emitting a sound beam of the first channel so that a total number of emitted beams is less than a number of the input audio signals of the first, second, and third channels.

4. The method according to claim 3, wherein a phantom sound image is formed by the first and second sound beams.

5. A sound beam control method for a speaker array apparatus comprising a plurality of speakers, the method comprising:

a signal dividing step of dividing an input audio signal of a first channel into first and second audio signals at a predetermined ratio;

a first mixing step of mixing the first audio signal with an input audio signal of a second channel that is different from the first channel and outputting a first mixed audio signal;

a second mixing step of mixing the second audio signal with an input audio signal of a third channel that is different from the first and second channels and outputting a second mixed signal; and a control step of controlling directivities of the first and second mixed audio signals by controlling delay times of the first and second mixed audio signals input to each of the speakers so that the speaker array emits first and second sound beams of the first and second mixed audio signals, respectively, in directions corresponding respectively to the second and third channels, which are directed to a wall surface that reflects the first and second mixed audio signals, without separately emitting a sound beam of the first channel so that a total number of emitted beams is less than a number of the input audio signals of the first, second, and third channels.

6. The method according to claim 5, wherein a phantom sound image is formed by the first and second sound beams.

* * * * *